United States Patent [19]

Rozenfeld

[11] 4,140,985

[45] Feb. 20, 1979

[54] STUB-TUNER FOR A HYPERFREQUENCY COAXIAL LINE OPERATING AT HIGH ENERGY LEVELS

[75] Inventor: Lucien Rozenfeld, Buc, France

[73] Assignee: CGR-MeV, Buc, France

[21] Appl. No.: 767,323

[22] Filed: Feb. 10, 1977

[30] Foreign Application Priority Data

Feb. 13, 1976 [FR] France ..... 76 04084
Feb. 3, 1976 [FR] France ..... 76 26616

[51] Int. Cl.[2] ..... H01P 1/28
[52] U.S. Cl. ..... 333/97 R; 333/82 B
[58] Field of Search ..... 333/97 R, 32, 31 R, 333/33 R, 82 B; 331/101

[56] References Cited

FOREIGN PATENT DOCUMENTS

| | | | |
|---|---|---|---|
| 128323 | 7/1948 | Australia | 333/97 R |
| 549756 | 12/1957 | Canada | 333/97 R |
| 579276 | 7/1946 | United Kingdom | 333/97 R |

*Primary Examiner*—Alfred E. Smith
*Assistant Examiner*—Marvin Nussbaum
*Attorney, Agent, or Firm*—Oblon, Fisher, Spivak, McClelland & Maier

[57] ABSTRACT

A stub-tuner for hyperfrequency coaxial line operating at high energy levels, comprising a first annular plate and a second annular plate arranged parallel to and one below the other, the plates being joined together by an outer ring and an inner ring which are respectively fixed to the outer and inner circumferences of the first and second annular plates, the rings being strips of blade-type contacts made of an elastic metallic material, means being provided for displacing the second annular plate relative to the first plate, these means comprising n push-jacks associated with a fluid-tight chamber into a fluid under pressure may be introduced, the n push-jacks so applying to the second plate a thrust directed perpendicularly thereof for pushing the second annular plate towards the first annular plate and so modifying the radius of curvature of the blade which rest under a predetermined pressure against the central and peripheral conductor walls, or push inner and outer strips of contactors, which are fixed upon the first plate, against the central and peripheral conductor walls.

16 Claims, 9 Drawing Figures

STUB-TUNER FOR A HYPERFREQUENCY COAXIAL LINE OPERATING AT HIGH ENERGY LEVELS

The stub-tuners, known as "short-circuit stubs", used in coaxial lines operating at high energy levels have to have a structure specially designed to ensure excellent contact between the stub-tuner and the walls of the central conductor and the peripheral conductor of the coaxial line.

Conventional stubs comprise elastic metallic contacts which bear permanently against the walls of the coaxial line, in particular during the movements of the stub. Accordingly, the pressure of these contacts on the walls cannot be very appreciable in order not to interfere with the movements of the stub. In fact, for the known type stubs, the quality of the contacts is inadequate for coaxial lines operating at high energy levels on account of the possible breakdowns and deterioration in these coaxial lines and the associated stubs in the case of faulty contacts.

The stub-tuner according to the present invention enables these disadvantages to be obviated.

According to the invention, a stub-tuner for hyperfrequency coaxial lines operating at high energy levels comprises a first annular plate, a second annular plate, said annular plates being arranged parallel to and below one another and being joined together by an outer ring which is fixed to the outer circumstances of said first and second annular plates and an inner ring which is fixed to the inner circumferences of said first and second annular plates, means for displacing said second plate relative to said first plate so as to vary the distance separating them and to modify the curvature of said outer and inner rings which may respectively bear, under a predetermined pressure, on the walls of the peripheral and central conductor of said coaxial line, said first plate being fixedly connected to an annular guide-block associated with means for moving said stub in the coaxial line, said means for displacing said second plate relative to said first plate comprising n push-jacks which are capable under the action of a fluid under pressure, of applying to said second annular plate a thrust directed perpendicularly thereof.

For a better understanding of the invention and to show how the same may be carried into effect, reference will be made to the drawings, given solely by way of example, which accompany the following description and wherein.

Figure 5:
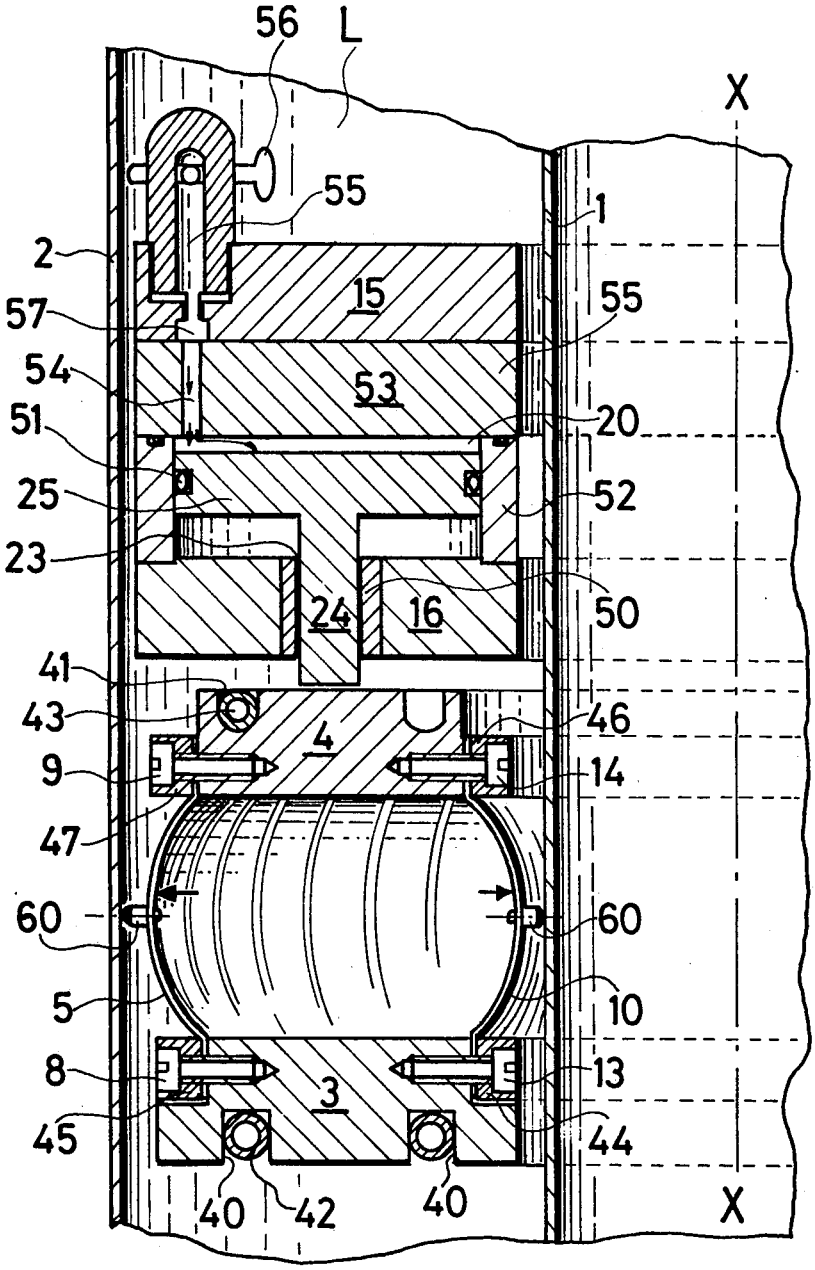
Figure 6:
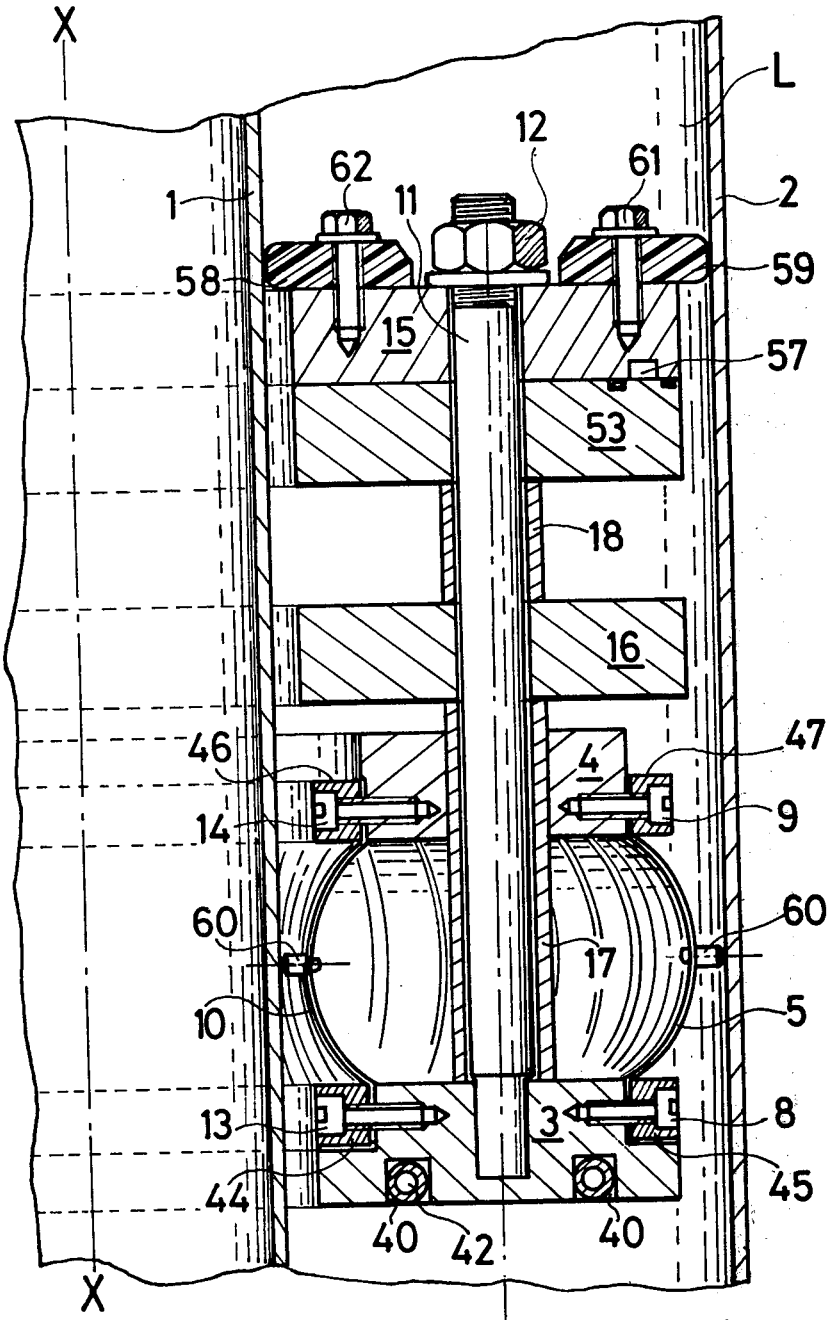
Figure 7:
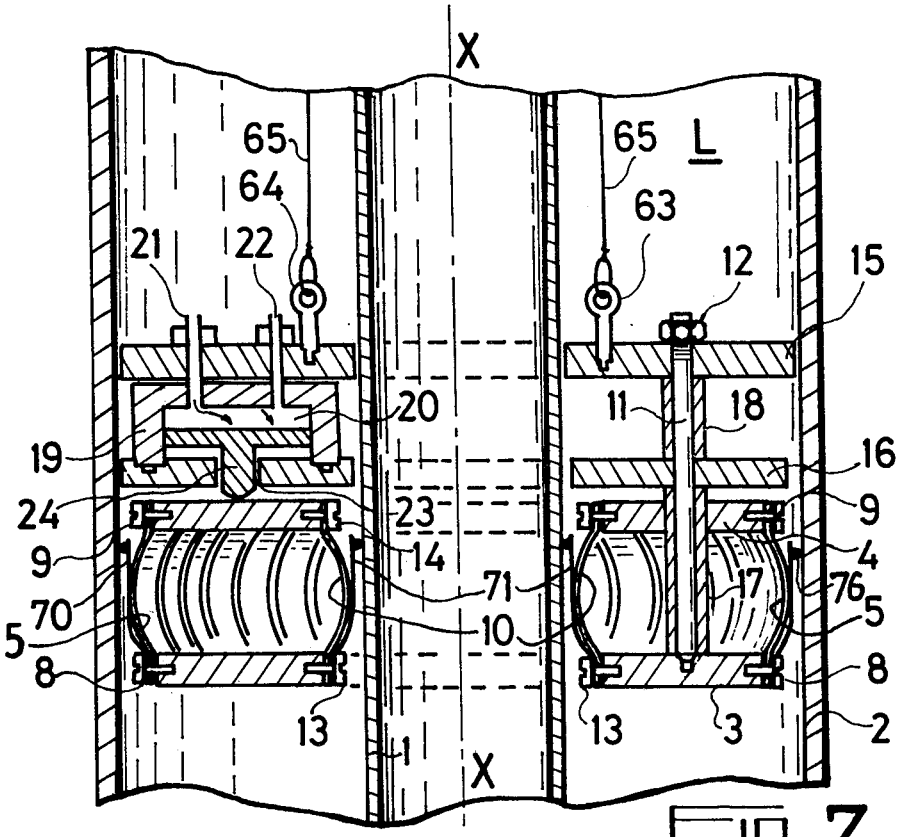
Figure 8:
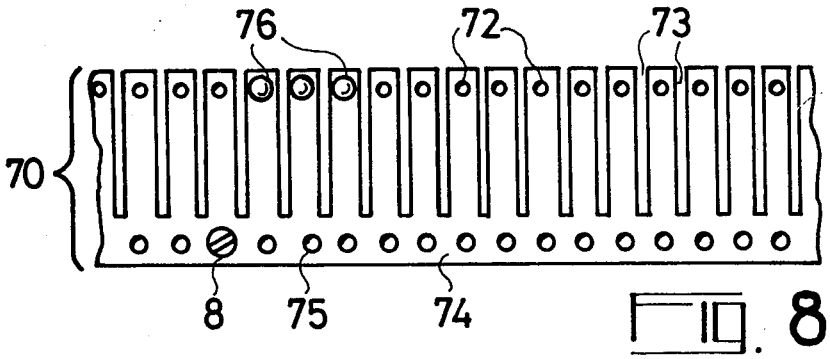
Figure 9:
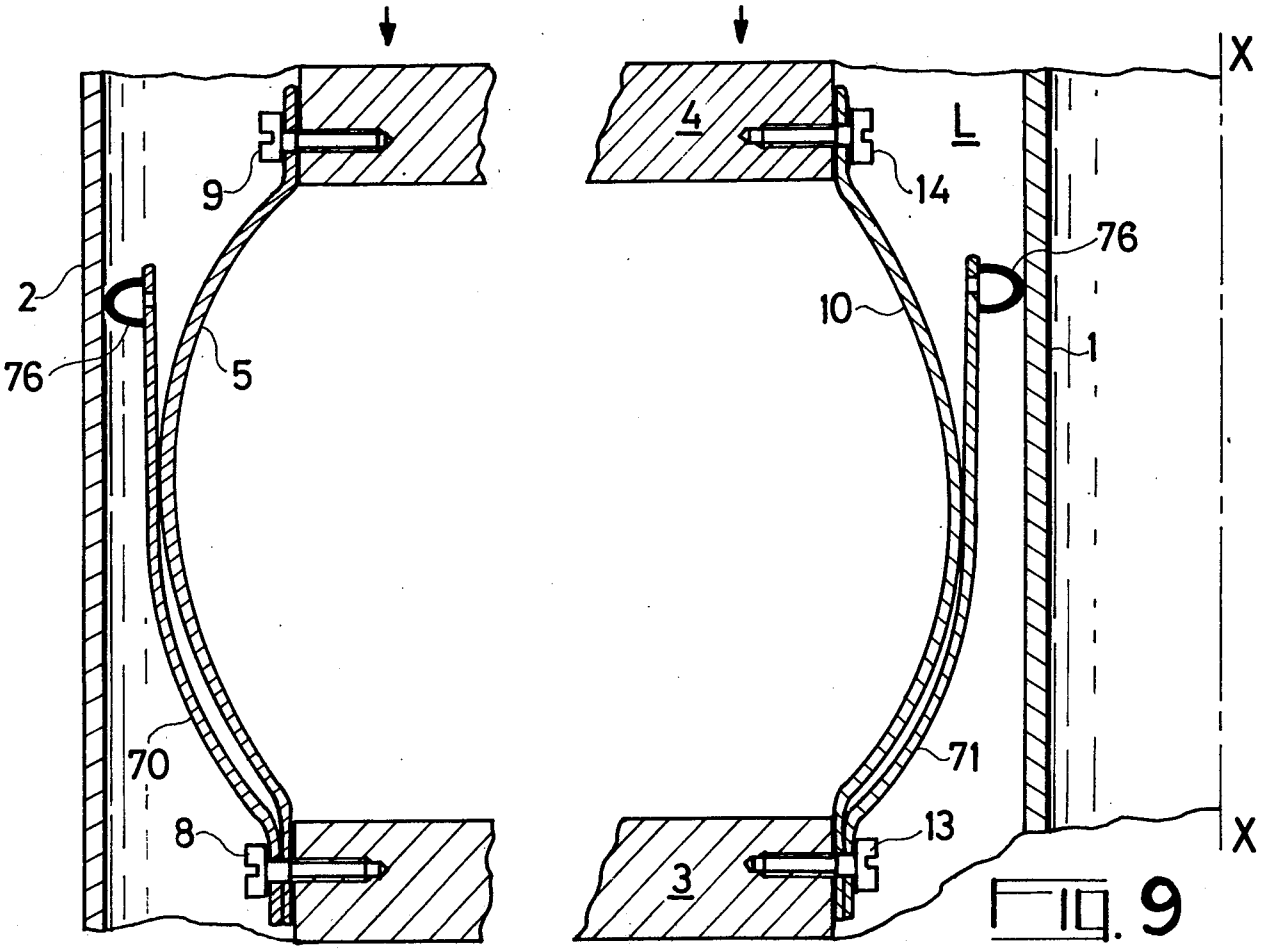

FIGS. 5 and 6 respectively illustrate details of another example of embodiment of a stub-tuner according to the invention;

FIG. 7 shows a third example of embodiment of a stub-tuner according to the invention;

FIGS. 8 and 9 illustrate some details of the stub-tuner.

Figure 1:
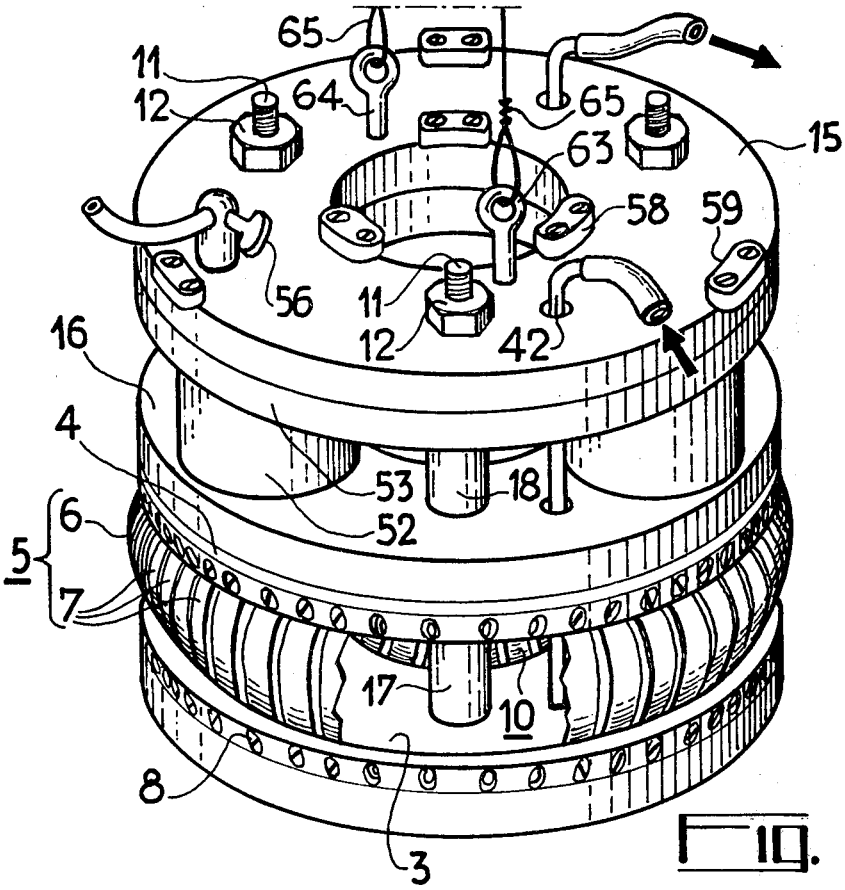
FIG. 1 is a perspective view of a stub-tuner according to the invention.
Figure 4:
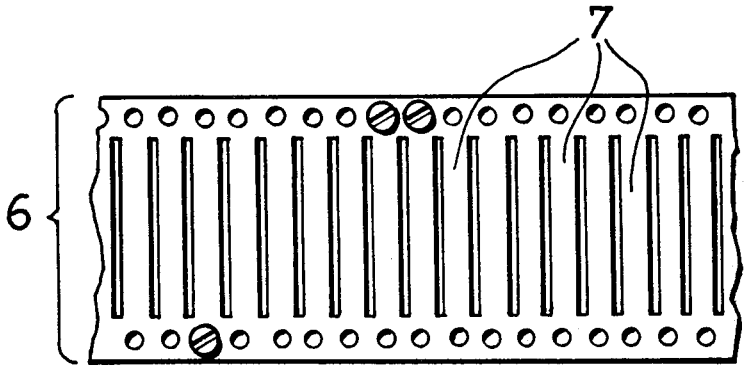
FIG. 4 shows a contact strip of a stub-tuner according to the invention.
Figure 2:
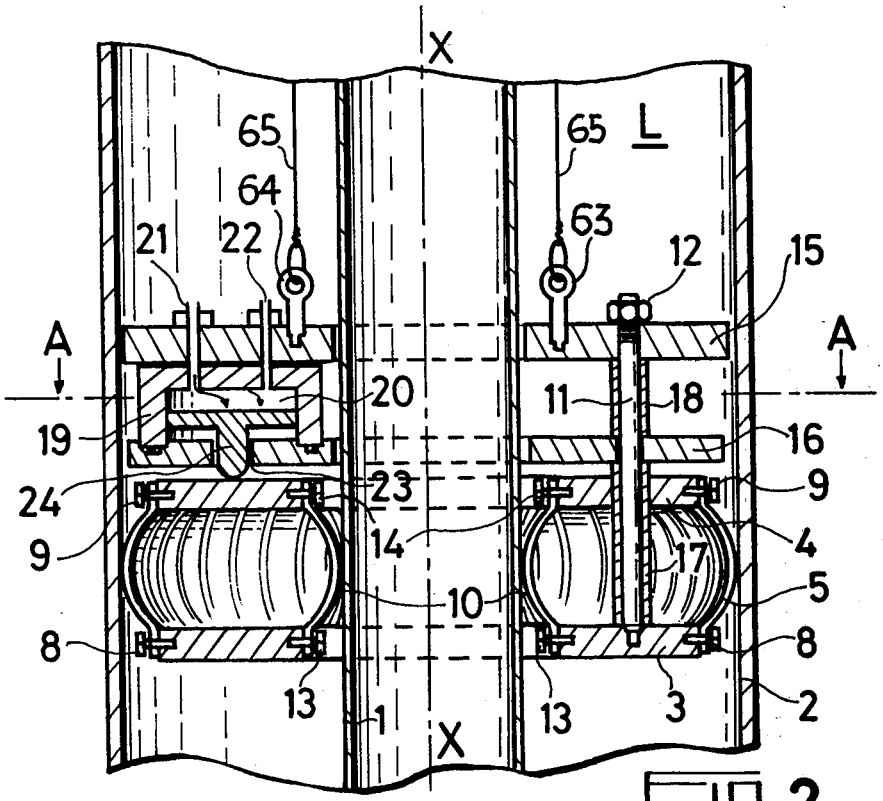
FIGS. 2 and 3 are, respectively, a longitudinal section and a cross-section through one example of embodiment of a stub-tuner according to the invention in a coaxial line.
Figure 3:
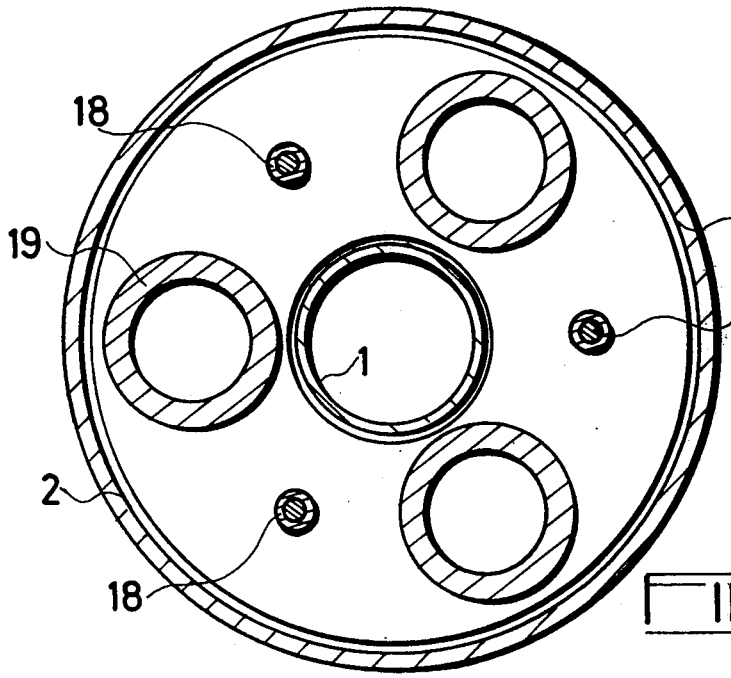

The "short-circuit" stub-tuner shown in perspective in FIG. 1 is designed for a high-energy coaxial line (coaxial line associated with a cyclotron for example) and, in particular, enables the frequency of the cyclotron with which it co-operates to be regulated. FIGS. 2 and 3 are, respectively, a longitudinal section and a cross-section through a first variant of this stub-tuner according to the invention. This stub-tuner arranged in a hyperfrequency coaxial line L of axis XX, consisting of a central conductor 1 and a peripheral conductor 2 of an electrically conductive material (for example copper) comprises:

a first annular plate 3;

a second annular plate 4, these two plates 3 and 4 being arranged parallel to and below one another;

an outer ring 5 constituted by a strip 6 of blades 7 (FIG. 4) of an elastic metallic material (for example glucinium bronze) this outer ring 5 being fixed to the outer circumference of the annular plate 3 by means of screws 8 and to the outer circumference of the annular plate 4 by means of screws 9;

an inner ring 10 formed by a strip identical with the strip 6 of blades 7, this inner ring 10 being fixed to the inner circumference of the annular plate 3 by means of screws 13 and to the inner circumference of the annular plate 4 by means of screws 14.

The annular plate 3 is fixedly connected to an annular guide-block 15 by means of rods 11, screwthreaded at least one of their ends, and nuts 12, the annular guide-block 15 enabling the stub-tuner to slide suitably along the walls of the central conductor 1 and the peripheral conductor 2 of the coaxial line. Between the annular guide-block 15 and the second annular plate 4 there is a third annular plate 16 which is parallel to the first annular plate 3 and to the second annular plate 4, the respective positions of these three plates 3, 4 and 16 being determined by tubular spacers 17 and 18 surrounding the rods 11, these spacers 17 and 18 being placed respectively between the first annular plate 13 and the third annular plate 16 on the one hand and between this third annular plate 16 and the annular guide-block 15 on the other hand. The third annular plate 16 is provided with n orifices 23 over which are arranged n cylindrical cups 19 (n = 3 in the embodiments illustrated). Each of these cups 19, of which the circular rim is brazed to the annular plate 16, is provided with an inlet 21 for the admission of fluid (for example gas under pressure) and with an outlet 22 for the removal of that fluid. The cylindrical cups 19 form chambers 20 in which are arranged push-jacks 24 the extremity of which is capable of moving freely in the holes 23 of the annular plate 16, and pushing under a predetermined pressure on the second annular plate 4.

In operation, after the suitable positioning of the stub-tuner in the coaxial line L, a gas under pressure is introduced into the chambers 20. The push-jacks 24 subjected to the pressure of the gas push the second annular plate 4 towards the first annular plate 3, thus reducing the distance separating them and modifying the radius of curvature of the blade rings 5 and 10 which bear respectively on the walls of the central conductor 1 and the peripheral conductor 2 of the coaxial line L (under a pressure which is determined by the pressure of the gas in the chambers 20), thus locking the stub-tuner in a predetermined position.

FIGS. 5 and 6 show details of another variant of the stub-tuner according to the invention shown in perspective in FIG. 1.

In the example of embodiment shown in FIG. 5, the chambers 20 are formed by n cylindrical sleeves 52 which are fixed to the third annular plate 16 and which are covered by an annular closure plate 53 formed with n ducts 54 respectively opening into the n chambers 20. The annular guide-block 15, arranged on the closure plate 53, is provided on that surface which is in contact with this closure plate 23, with a circular fluid distribution groove 57. This fluid is introduced into the groove 57 through a tube 55 equipped with a two-way cock 56, one corresponding to admission of the fluid and the other to removal of that fluid.

Each push-jack 24 is provided at its upper end with a disc 25 substantially identical in diameter with the chamber 20. A thight O-ring 51 is provided on the periphery of the disc 25 to ensure fluid-tightness of the chamber 20.

In this variant, the orifices 23 of the third annular plate 4, in which the push-jacks 24 make their movement, are surrounded by a tube 50 made of a material which ensures an easy fit of the push-jacks 24 (sintered bronze for example). In this variant, too, the annular plates 3 and 4 respectively comprise concentric circular grooves 40 and 41 in which may be arranges pipes 42 and 43 for the circulation of a cooling fluid.

In order to improve fixing of the rings 5 and 10 to the plates 3 and 4, perforated collars 44 to 47 are interposed between the screw heads 8, 9, 13, 14 and these rings 5 and 10 (FIGS. 5 and 6).

In order to improve the contact of the rings 5 and 10 with the walls of the inner and outer conductors 1 and 2 of the coaxial line L, provision is also made for one (or more) metallic contact pill to be placed at the centre of each blade 7 (FIGS. 5 and 6).

Since the rings 5 and 10 are able to apply a very considerable pressure to the walls of the coaxial line L, a safety system (not shown in the FIGS.) may be associated with the two-way cock 56, this safety system preventing the stub-tuner from moving in the coaxial line L when the cock is in the position in which it admits fluid.

In the embodiment illustrated in FIG. 6, the correct sliding of the annular guide block 15 along the walls of the central conductor 1 and the peripheral conductor 2 is ensured by inner guide elements 58 and outer guide elements 59 (for example three in number in each case) which are respectively fixed to the inner and outer edges of the annular guide block 15 by means of screws 61 and 62. These elements may be made of polyamino-11-undecanoic acid, this material being marketed under the same RILSAN. FIG. 1 shows the arrangement of these elements 58 and 59 on the annular block 15.

The examples of embodiment described and illustrated are by no means limiting. In particular, the number of push-jacks 24, limited to three in the foregoing description, may be greater. The same applies to the rods 11 for fixing the annular plate 3 to the annular guide block 15.

The means for displacing the short-circuit stub-tuner in the coaxial line comprise lifting rings 63 and 64 (FIGS. 1 and 2), the stub-tuner being suspended from a pulley by means 65 mounted to slide in the lifting rings 63 and 54.

FIG. 7 illustrates another embodiment of a stub-tuner in accordance with the invention. In this embodiment outer and inner rings 5, 10 are associated with two strips of contactors 70, 71 as shown in FIG. 9, made of an elastic metallic material. The strips of contactors 70, 71 comprise blades 72 of equal width which are separated by equal gaps 73 (FIG. 8). The width of the blades 72 and the gaps 73 separating the blades 72 are respectively equal to the width of the blades 7 and the width of the gaps separating them (FIG. 4) of the outer and inner rings 5 and 10. The blades 72 of the strips of contactors 70 and 71 are respectively arranged opposite the blades 7 of the outer and inner rings 5 and 10. The blades 72 are supported at one of their ends by an edge 74 (FIG. 3), like the teeth of a comb, whilst the other end is free.

The band 74 is provided with holes 75 of which the dimensions and positions are identical with the dimensions and positions of the holes 34 formed in the lower band 32 of the corresponding outer ring 5, or the inner rings 10 which enables both the outer ring 5 and the strip of contactors 70 to be fixed to the outer circumference of the annular plate 3 by means of screws 8. The free ends of the blades 72 may be provided contact pills 76, as shown in FIG. 3.

The height strips of contactors 70, 71 is more important than $h_1/2$, $h_1$ being the height of the outer and inner rings 5, 10.

In operation, with the stub-tuner suitably positioned in the coaxial line L, a gas under pressure is introduced into the chambers 20. The push-jacks 24, subjected to the pressure of the gas, push the second annular plate 4 towards the first annular plate 3, thus reducing the distance separating them and modifying the radius of curvature of the blades of the rings 5 and 10 which respectively push the blades of the strips of contactors 70 and 71 against the walls of the peripheral conductor 2 and the central conductor 1 of the coaxial line L under a pressure which is determined by the pressure of the gas in the chambers 20, thus locking the piston in a predetermined position. Contacts can be improved by contact pills 76 which are fixed as shown in FIG. 7, on the blades 72 of the strips of contactors 70 and 71. Thus, the stub-tuner in accordance with the invention corresponding to the last embodiment may be used with advantage in coaxial lines having concentricity faults.

What I claim is:

1. A stub-tuner for a hyperfrequency coaxial line having a peripheral and a central conductor, said stub-tuner designed for operating at high energy levels, comprising a first annular plate, a second annular plate, said annular plates being arranged parallel to and below one another and being joined together by an outer ring which is fixed to the outer circumference of said first and second annular plates and an inner ring which is fixed to the inner circumference of said first and second annular plate, displacing means for displacing said second annular plate relative to said first plate so as to vary the distance separating them and for modifying the radius of curvature of said outer and inner rings and respectively setting up said outer and inner rings against the wall of said peripheral and central conductors of said coaxial line with a predetermined pressure, said outer and inner rings being constituted with two strips of blade-type contacts made of an elastic metallic material, said first plate being rididly fixed to an annular guide block which is connected to means for moving said stub-tuner in the coaxial line, said displacing means comprising n push-jacks which are capable, under the action of a fluid under pressure, of applying to said annular plate a thrust directed perpendicularly thereof.

2. A stub-tuner as claimed in claim 1, wherein said strips of blade contacts are formed by a band of beryllium bronze comprising a series of parallel slots extending perpendicularly of the edges of the strip, the height of said slots being less than the hight of band.

3. A stub-tuner as claimed in claim 2, wherein said edges of each of said strips forming said rings comprise holes formed at the two ends of each of said blades, said holes enabling the rings to be fixed to said annular plates by means of screws.

4. A stub-tuner as claimed in claim 1, comprising n chambers formed by n cylindrical cups of which the circular edges are fixed to a third annular plate which is parallel to said first and second annular plates, said third plate being provided with n orifices in which said push-jacks are capable of moving freely, each push-jack being surmounted by a disc substantially equal in diameter to said chamber in which it is arranged, said disc being provided at its periphery with a tight O-ring.

5. A stub-tuner as claimed in claim 4, wherein each of said chambers is provided with an inlet pipe and an outlet pipe for the admission and the removal of said pressured-fluid.

6. A stub-tuner as claimed in claim 1, comprising n chambers formed by n cylindrical sleeves fixed to a third annular plate which is parallel to said first and second annular plates, said n cylindrical sleeves being collectively surmounted by a closure plate provided with n ducts opening respectively into said n chambers, said ducts being provided for the successive admission and removal of said pressured-fluid, said annular guide block, which is arranged on said closure plate being provided with a circular groove for the distribution of said fluid, said groove being formed on the surface of said annular guide block which is in contact with said closure plate, the fluid which is introduced into the groove through a tube being delivered into the chambers by means of said ducts, said tube being equipped with a two-way cock which is associated with a safety system preventing the stub-tuner from moving in the coaxial line when the cock is in the position in fluid-admission.

7. A stub-tuner as claimed in claim 1, wherein said first annular plate is fixed to the annular guide block by means of screwthreaded rods, and nuts.

8. A stub-tuner as claimed in claim 7, wherein tubular spacers are arranged around the rods respectively between the first annular plate and the third annular plate and between this third annular plate and said guide block.

9. A stub-tuner as claimed in claim 1, wherein said annular guide block is provided with guide elements of a self-lubricating material around the inner periphery and outer periphery of the upper surface of said annular guide-block.

10. A stub-tuner as claimed in claim 1, wherein said guide elements are made of polyamino-11-undecanoic acid, enregistred trade mark RILSAN.

11. A stub-tuner as claimed in claim 1, wherein said first and second annular plates are provided with substantially circular channels in which pipes for the circulation of a cooling fluid may be arranged.

12. A stub-tuner as claimed in claim 3, wherein perforated collars are respectively arranged between said inner and outer rings and the heads of said screws fixing said inner and outer rings to said first and second annular plates.

13. A stub-tuner as claimed in claim 1, wherein said outer and inner rings are respectively associated with an outer and an inner strips of contactors which are respectively fixed at one of their edges to the outer circumference and to the inner circumference of said first annular plate, the other edge of said strips of contactors being free, said strips of contactors having a height $h_2 > h_1/2$, $h_1$ being the height of said rings.

14. A stub-tuner as claimed in claim 13, wherein said strips of contactors are formed with blades, said blades being separated with one another by intervals which are equal to the intervals separating the blades of said outer and inner rings, said blades of said outer strip of contactors being opposite the blades of said outer ring and the blades of said inner strip of contactors being opposite the blades of said inner ring.

15. A stub-tuner as claimed in claim 14, wherein the blades of said strips of contactors are provided, at their free end, with contact pills intended to come into contact with said walls of the outer and inner conductors of said coaxial line.

16. A short circuit piston as claimed in claim 13, wherein the fixation edges of the strips of contactors are provided with holes to enable them to use screws for fixing the outer and inner rings to said first annular plate.

* * * * *